US009162481B2

(12) United States Patent
Moriyama et al.

(10) Patent No.: US 9,162,481 B2
(45) Date of Patent: Oct. 20, 2015

(54) PRINT MEDIUM

(71) Applicants: Satoru Moriyama, Iwakura (JP); Mitsuhiro Kanda, Nagoya (JP)

(72) Inventors: Satoru Moriyama, Iwakura (JP); Mitsuhiro Kanda, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 41 days.

(21) Appl. No.: 14/037,477

(22) Filed: Sep. 26, 2013

(65) Prior Publication Data

US 2014/0152753 A1 Jun. 5, 2014

(30) Foreign Application Priority Data

Dec. 4, 2012 (JP) ..... 2012-264925

(51) Int. Cl.

| | |
|---|---|
| ***B41J 29/38*** | (2006.01) |
| ***B41J 3/407*** | (2006.01) |
| ***B42D 15/00*** | (2006.01) |
| ***B41J 11/00*** | (2006.01) |
| ***B41J 11/46*** | (2006.01) |
| ***G09F 3/00*** | (2006.01) |
| *G09F 3/02* | (2006.01) |

(52) U.S. Cl.

CPC ..... *B41J 3/4075* (2013.01); *B41J 11/009* (2013.01); *B41J 11/46* (2013.01); *B42D 15/00* (2013.01); *G09F 3/0297* (2013.01); *G09F 2003/0229* (2013.01)

(58) Field of Classification Search

CPC .... B41J 11/46; B41J 11/0095; B41J 11/0009; B41J 11/42; B41J 11/425; B41J 11/009; B41J 3/4075

USPC ..... 347/16, 218, 104, 110

See application file for complete search history.

(56) References Cited

U.S. PATENT DOCUMENTS

| | | | | |
|---|---|---|---|---|
| 4,477,103 | A | 10/1984 | Bertolazzi | |
| 5,442,188 | A | 8/1995 | Brimbal et al. | |
| 2009/0167013 | A1 * | 7/2009 | Horikoshi | 283/81 |

FOREIGN PATENT DOCUMENTS

| | | |
|---|---|---|
| JP | 09240121 | 9/1997 |
| JP | 11-309912 | 11/1999 |
| JP | 2000-141775 | 5/2000 |
| JP | 2010-221485 | 10/2010 |
| JP | 2011025434 | 2/2011 |
| WO | 2011/146603 | 11/2011 |

OTHER PUBLICATIONS

Extended European Search Report issued in Application No. 13185941.5 on Mar. 21, 2014.

* cited by examiner

*Primary Examiner* — Henok Legesse

(74) *Attorney, Agent, or Firm* — McCarter & English, LLP

(57) ABSTRACT

A print medium includes a plurality of print areas and a plurality of identification markers. The plurality of print areas are set along a longitudinal direction on a printing surface. The plurality of print areas are a plurality of areas on which printing is to be performed. The plurality of identification markers are intermittently printed along the longitudinal direction on the print medium. Each of the plurality of identification markers includes a set of leading edge information and identification information and is printed in correspondence with a single print area group. The leading edge information is information for setting a leading edge position of the print area in the feed direction. The identification information is information for identifying a type of the print medium. The print area group is formed of a plurality of mutually adjacent print areas among the plurality of print areas.

4 Claims, 8 Drawing Sheets

PRINT MEDIUM

CROSS-REFERENCE TO RELATED APPLICATION

This application claims priority to Japanese Patent Application No. 2012-264925, filed Dec. 4, 2012, the content of which is hereby incorporated herein by reference in its entirety.

BACKGROUND

The present disclosure relates to a long sheet-shaped print medium, a printer, and a medium.

A long sheet-shaped print medium and a printer that prints characters etc. on the print medium are known. For example, a label paper is known in which a plurality of labels are provisionally attached at a predetermined interval on the top surface of a belt-shaped base paper, and detection markers are printed on the rear surface on a side edge in positions corresponding to a leading edge of each of the labels. A label printer detects the leading edge position of each individual label by reading the detection marker using a photo-detector. The label printer reads a number of a plurality of lines that form the detection marker and reads intervals between the plurality of lines to distinguish a label type, and then performs printing on the label paper.

SUMMARY

However, with the above-described label paper, the leading edge position of each individual label is indicated by a single detection marker, and one detection marker corresponds to one label. As a result, when the length of the detection marker in the feed direction of the label paper is longer than the length of the label, adjacent detection markers are arranged such that the adjacent detection markers overlap with each other. In this case, a margin portion between the labels may be made larger such that the adjacent detection markers do not overlap with each other, but there is a case in which an unused portion of the label paper increases. Further, it is possible to shorten the length of the detection marker in the feed direction by using a photo-detector that has high readout accuracy, but there is a case in which production costs become higher.

Embodiments of the broad principles derived herein provide a print medium, a printer and a medium that allow printing without waste even when a length of a print area in a feed direction is shorter than a length of an identification marker.

Various embodiments provide a print medium includes a plurality of print areas and a plurality of identification markers. The plurality of print areas are set along a longitudinal direction on a printing surface. The longitudinal direction is a direction in which the print medium in sheet form extends and is a direction along a feed direction in which the print medium is to be fed when printing is performed. The plurality of print areas are a plurality of areas on which printing is to be performed. The plurality of identification markers are intermittently printed along the longitudinal direction on the print medium. Each of the plurality of identification markers includes a set of leading edge information and identification information and is printed in correspondence with a single print area group. The leading edge information is information for setting a leading edge position of the print area in the feed direction. The identification information is information for identifying a type of the print medium. The print area group is formed of a plurality of mutually adjacent print areas among the plurality of print areas.

Embodiments also provide a printer includes a read portion, a processor, a memory, and a printing portion. The read portion is configured to read an identification marker printed on a print medium. The print medium includes a plurality of print areas and a plurality of identification markers. The plurality of print areas are set along a longitudinal direction on a printing surface. The longitudinal direction is a direction in which the print medium in sheet form extends and is a direction along a feed direction in which the print medium is fed at a time of printing. The plurality of print areas are a plurality of areas on which printing is performed. The plurality of identification markers are intermittently printed along the longitudinal direction on the print medium. Each of the plurality of identification markers includes a set of leading edge information and identification information and is printed in correspondence with a single print area group. The leading edge information is information for setting a leading edge position of the print area in the feed direction. The identification information is information for identifying a type of the print medium. The print area group is formed of a plurality of mutually adjacent print areas among the plurality of print areas. The memory is configured to store computer-readable instructions therein that, when executed by the processor, cause the printer to identify the leading edge position of each of the print areas based on the leading edge information included in the identification marker that is read by the read portion. The printing portion is configured to perform printing in accordance with print data based on the identified leading edge position.

Embodiments further provide a medium includes a plurality of areas and a plurality of identification markers. The plurality of areas are set along a first direction on a first surface. The plurality of identification markers are arranged along the first direction on the first surface or a second surface that is a rear surface of the first surface. The first arrangement interval is the integral multiple that is equal to or more than 2 of a second arrangement interval. The first arrangement interval is an arrangement interval between downstream side edges of the plurality of identification markers in the first direction. The second arrangement interval is an arrangement interval between downstream side edges of the plurality of areas in the first direction.

BRIEF DESCRIPTION OF THE DRAWINGS

Embodiments will be described below in detail with reference to the accompanying drawings in which.

DETAILED DESCRIPTION

Figure 1:
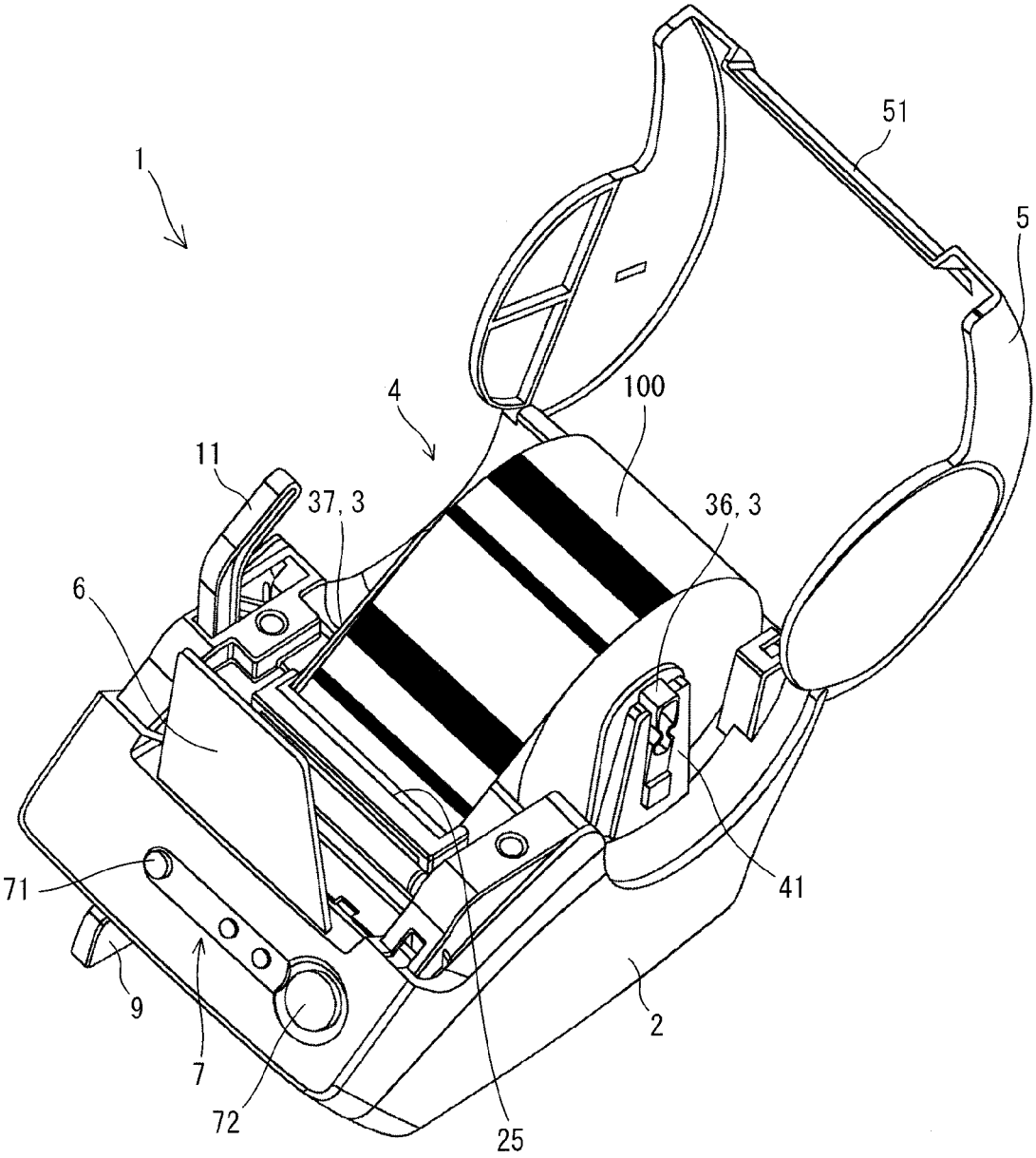
FIG. 1 is a perspective view of a label printer that houses a sheet wound in roll form, with a cover in an open position.

Hereinafter, an embodiment of the present disclosure will be explained with reference to the drawings. Note that the drawings referred to are used to explain technological features that can be adopted by the present disclosure. Configurations of devices noted in the drawings, and flowcharts of various processing etc. are not limited only to the examples given and are simply explanatory examples.

An outline configuration of a sheet 100 and a label printer 1, which are an example of a print medium and a printer respectively of the present disclosure, will be explained with reference to FIG. 1 and FIG. 2. In the following explanation, the upper right side, the lower left side, the lower right side, the upper left side, the upper side and the lower side in FIG. 1 respectively correspond to the rear side, the front side, the right side, the left side, the top side and the bottom side of the label printer 1. Note that FIG. 2 shows a longitudinal section of the label printer 1 in a state in which a cover 5 is closed, but an illustration of the cover 5 is omitted.

Figure 2:
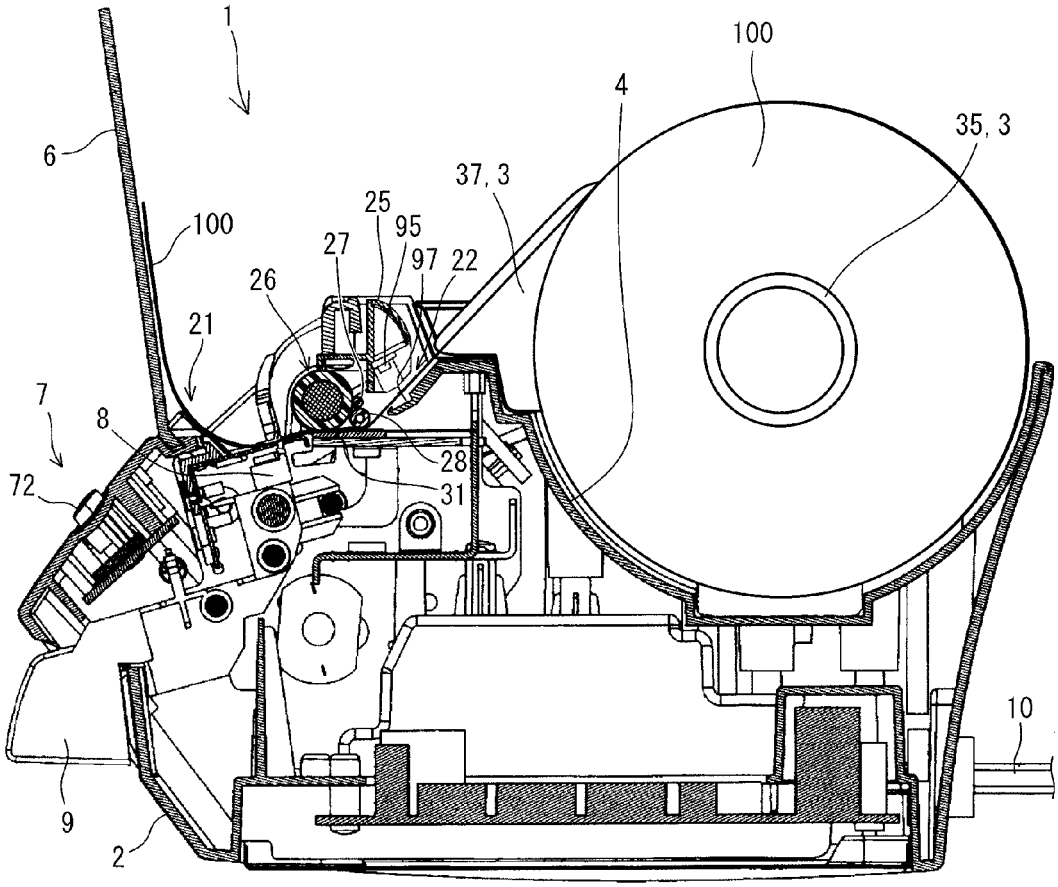
FIG. 2 is a longitudinal section of the label printer.

As shown in FIG. 1, the label printer 1 is a printer that is configured to print various characters (letters, numerals, symbols and graphics etc.) on a long label sheet (hereinafter simply referred to as a "sheet") 100. The label printer 1 has a rectangular parallelepiped shape and the top surface of the cover 5 is a rounded arc-shape. The label printer 1 includes a housing 2 and the cover 5. The housing 2 is a main body of the label printer 1. The cover 5 is rotatably supported on a rear portion of the housing 2, such that the cover 5 can cover a part of the top surface of the housing 2. The front surface of the housing 2 includes a cutting lever 9 that is configured to move in the left-right direction. The cutting lever 9 is coupled to a cutter unit 8 (refer to FIG. 2). When a user moves the cutting lever 9 in the left and right directions, the cutter unit 8 moves to the left and right and cuts the sheet 100 after printing.

An operation portion 7 that includes various keys, such as a FEED key 71 and a power supply key 72, is provided on the top surface of a front portion of the housing 2. A plate-shaped transparent plastic tray 6 is provided in a standing manner to the rear of the operation portion 7. To the rear of the tray 6, when the cover 5 is closed, a discharge outlet 21 (refer to FIG. 2) that is long in the left-right direction is formed between the housing 2 and a front edge portion 51 of the cover 5. The tray 6 can receive the printed sheet 100 that is discharged from the discharge outlet 21.

A connector (not shown in the drawings) that can be connected to a power supply cord 10 (refer to FIG. 2) is provided on the back surface of the housing 2, toward one of the side surfaces. Although not shown in the drawings, a universal serial bus (USB) connector that can be connected to a USB cable and a local area network (LAN) connector that can be connected to a LAN cable are provided on the back surface of the housing 2. The label printer 1 can be connected to an external device, such as a personal computer (not shown in the drawings, hereinafter referred to as a PC), via the USB connector or the LAN connector.

A storage portion 4 is provided in a rear portion inside the housing 2. The storage portion 4 is recessed downward in a rounded arc shape in a side view (refer to FIG. 2). A holder 3, which holds the sheet 100 that is wound in a roll form on a spool 35 (refer to FIG. 2), is detachably housed in the storage portion 4. The sheet 100 is formed, for example, of a long size heat-sensitive sheet (so-called thermal paper) that has self-color-development characteristics, and a long size print tape to which a release paper is adhered by an adhesive on one surface of the head-sensitive sheet. The sheet 100 of the present embodiment is a label sheet on which a plurality of labels 150 (refer to FIG. 4) are arranged side by side on a print surface (a top surface 110), by cutting plate shape notches of a predetermined size at equal intervals on a heat-sensitive sheet to which a release paper is adhered.

The holder 3 includes the spool 35, a holding member 36 and a guide member 37. The sheet 100 is wound around the spool 35. The holding member 36 is disposed on one end side of the spool 35. The guide member 37 is disposed on the other end side of the spool 35. The sheet 100 is wound around the spool 35 such that the print surface is on the inside. The holding member 36 and the guide member 37 rotatably hold the spool 35 on which the sheet 100 is wound. When the holder 3 is housed in the storage portion 4 of the label printer 1, the holding member 36 positions and supports the holder 3 inside the storage portion 4. The guide member 37 comes into contact with a side surface of the sheet 100 wound in the roll form, and inhibits the sheet 100 from becoming displaced in the width direction.

The holder 3 can be mounted in or detached from the storage portion 4 when the cover 5 is in an open position. The holder 3 is housed in the storage portion 4 in a state in which an axial line of the spool 35 is oriented in the left-right direction of the label printer 1, with the holding member 36 disposed on the right side and the guide member 37 on the left side. The storage portion 4 includes a supporting portion 41, a leading end of which is forked, that is provided in an upright manner facing upward on an end portion on the right side of the storage portion 4. The holding member 36 of the holder 3 is clipped into the supporting portion 41, and thus positions and holds the holder 3 inside the storage portion 4. By changing the length of the spool 35 in accordance with the width of the sheet 100, the label printer 1 can deal with the sheet 100 of various widths. A plurality of identification markers 160 are printed intermittently at a predetermined interval on an outside surface (a rear surface 120) of the wound sheet 100. Each of the plurality of identification markers 160 includes a plurality of identifiers that extend in a band shape in the width direction of the sheet 100. The identification markers 160 are read by an optical sensor 95 (refer to FIG. 3) that will be explained later. The identification markers 160 will be explained in more detail later.

A lever 11 is provided to the left front of the storage portion 4 in the housing 2. A roller holder 25 that is long in the left-right direction is provided to the right side of the lever 11. As shown in FIG. 2, the roller holder 25 rotatably holds a platen roller 26, a connecting roller 27 and a feed roller 28 with an axial direction of the roller holder 25 being the left-right direction. A plate-shaped thermal head 31 is disposed below the roller holder 25, facing the platen roller 26 and the feed roller 28. The roller holder 25 moves in the up-down direction around a point of support at rear end of the roller holder 25, in conjunction with a rotation of the lever 11 in the up-down direction.

The lever 11 is constantly urged in the upward direction by a spiral spring that is not shown in the drawings. When the cover 5 is closed, the lever 11 rotates in the downward direction in resistance to the urging force of the spiral spring. When the lever 11 rotates in the downward direction, the roller holder 25 moves downward and the platen roller 26 and the feed roller 28 press the sheet 100 toward the thermal head 31. In this case, the label printer 1 is in a state in which the label printer 1 is able to perform printing. On the other hand, when the cover 5 is opened, the lever 11 rotates in the upward direction. When the lever 11 moves in the upward direction, the roller holder 25 moves in the upward direction, and the platen roller 26 and the feed roller 28 are separated from the thermal head 31 and the sheet 100. In this case, the label printer 1 is in a state in which the label printer 1 is not able to perform printing.

A feed path 22 of the sheet 100 is provided on the front side of the storage portion 4 (the left side in FIG. 2). The feed path 22 extends diagonally toward the front and downward (diagonally to the left and downward in FIG. 2), and then bends and extends further toward the front. The feed path 22 passes between the feed roller 28 and the thermal head 31, and also between the platen roller 26 and the thermal head 31, and extends toward the discharge outlet 21 provided in the top surface of the label printer 1. Note that, as described above, the discharge outlet 21 is formed by the front edge portion 51 of the cover 5 and the housing 2, but in FIG. 2, the illustration of the cover 5 is omitted. Thus, only a part of the discharge outlet 21 formed by the housing 2 is shown in FIG. 2.

In the present embodiment, printing is performed while the sheet 100 is fed along the feed path 22 from the storage portion 4 to the discharge outlet 21. In the following explanation, the direction in which the sheet 100 is fed along the feed path 22 is referred to as the feed direction of the sheet 100. On the feed path 22, the side of the storage portion 4 in the feed direction is referred to as an upstream side of the feed path 22, and the side of the discharge outlet 21 in the feed direction is referred to as the downstream side of the feed path 22. Normally, during printing, the sheet 100 is fed from the upstream side toward the downstream side.

As shown in FIG. 2, the platen roller 26, the feed roller 28, the connecting roller 27 and the thermal head 31 are positioned substantially in the center of the feed path 22 in the front-rear direction. The thermal head 31 is provided with a plurality of heater elements (not shown in the drawings) disposed in a position facing the platen roller 26. The plurality of heater elements are arranged in a row in a direction that is orthogonal to the feed direction. Using the heater elements, the thermal head 31 performs printing on the sheet 100 that is sandwiched between the platen roller 26 and the heater elements. Hereinafter, a position between the platen roller 26 and the heater elements in which printing is performed on the sheet 100 is referred to as a print position. The platen roller 26 is urged toward the thermal head 31. The platen roller 26 is connected to a feed motor 210 (refer to FIG. 3) by a gear that is not shown in the drawings. The platen roller 26 rotates in a positive rotation or a reverse rotation in accordance with driving of the feed motor 210. The positive rotation (the clockwise direction in FIG. 2) is a rotation such that the sheet 100 is fed toward the downstream side. The reverse rotation (the counter-clockwise direction in FIG. 2) is a rotation such that the sheet 100 is fed toward the upstream side.

The feed roller 28 is disposed to the rear of the platen roller 26 such that the feed roller 28 is slightly separated from the platen roller 26. The connecting roller 27 is disposed between the platen roller 26 and the feed roller 28. The outer peripheral surface of the connecting roller 27 is in contact with the outer peripheral surface of the platen roller 26 and the outer peripheral surface of the feed roller 28. The connecting roller 27 transfers motive power from the platen roller 26 to the feed roller 28. The feed roller 28 rotates in the same direction as the platen roller 26 by the motive power transferred from the platen roller 26 via the connecting roller 27.

The platen roller 26 and the feed roller 28 come into contact with the surface on the same side of the sheet 100 (the top side surface in FIG. 2) and sandwich the sheet 100 with the thermal head 31. By the platen roller 26 and the feed roller 28 rotating in the same direction while the sheet 100 is sandwiched between them and the thermal head 31, the sheet 100 is fed along the feed direction. The sheet 100 is fed in one of either a forward direction or a reverse direction. The forward direction is the direction from the upstream side to the downstream side. The reverse direction is the direction from the downstream side to the upstream side. The printing on the sheet 100 is performed one line at a time by the single row of heater elements that are arranged on the thermal head 31 in the direction that is orthogonal to the feed direction.

The optical sensor 95 is provided diagonally to the rear of and above the connecting roller 27 and the feed roller 28. The optical sensor 95 of the present embodiment is a reflection-type sensor. By a light receiving portion that uses a phototransistor or the like, the optical sensor 95 receives reflected light that is reflected back by the sheet 100 from light that is irradiated from a light emitting portion, and outputs a detection value depending on the strength of the reflected light. Based on the detection value of the optical sensor 95, a CPU 201 (refer to FIG. 3) that is connected to the optical sensor 95 can read information included in the identification marker 160 (refer to FIG. 4) that is printed on the sheet 100. A reflector plate 97 is provided in a position facing the optical sensor 95 such that the feed path 22 passes therebetween. In a case where the sheet 100 is not disposed on the feed path 22, the irradiated light of the optical sensor 95 is reflected back by the reflector plate 97 and the reflected light is received by the light receiving portion. At this time, a detection value of the optical sensor 95 is different to a detection value when the identification marker 160 has been detected. Thus, the CPU 201 can detect that the sheet 100 is not disposed on the feed path 22.

The cutter unit 8, which has a fixed blade and a movable blade, is provided between the platen roller 26 and the discharge outlet 21. By the user moving the cutting lever 9 in the left-right direction, the sheet 100 is sandwiched between the fixed blade and the movable blade and the sheet 100 is cut.

Figure 3:
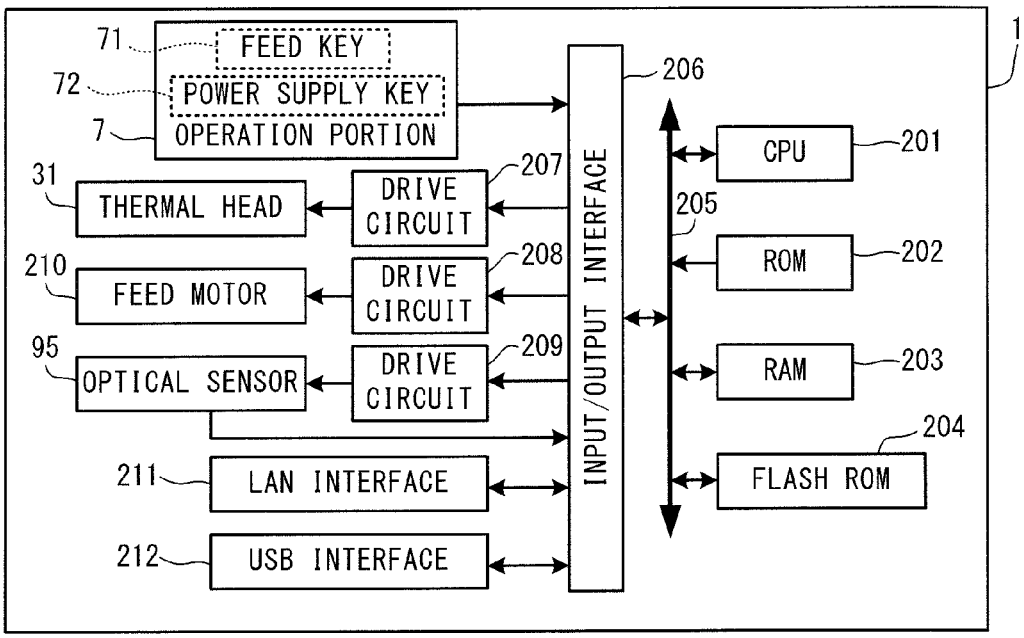
FIG. 3 is a block diagram showing an electrical configuration of the label printer.

An electrical configuration of the label printer 1 will be explained with reference to FIG. 3. As shown in FIG. 3, the label printer 1 includes the CPU 201, a ROM 202, a RAM 203 and a flash ROM 204, which are connected to each other by a bus 205. The CPU 201 performs overall control of the label printer 1. Various programs, such as a print control program that will be described later, control data necessary for the programs and so on are stored in the ROM 202. The CPU 201 performs various calculations and control processing in accordance with the programs stored in the ROM 202. A large number of character fonts and the like are also stored in the ROM 202.

Various calculation results etc. by the CPU 201 are temporarily stored in the RAM 203. Although not shown in the drawings, storage areas such as a received data storage area that stores print data received from the external device, a print buffer that stores dot pattern data for printing when printing is performed, and a work area etc. are provided in the RAM 203. The dot pattern data is expanded into the print buffer based on the print data received from the external device and on the character fonts stored in the ROM 202. The flash ROM 204 is a non-volatile memory and stores various information.

An input-output interface 206 is connected to the bus 205. The operation portion 7, drive circuits 207, 208 and 209, a LAN interface 211 and a USB interface 212 are connected to the input-output interface 206. The operation portion 7 includes the FEED key 71 and the power supply key 72. The FEED key 71 is a key that is operated when performing paper cueing of the sheet 100 and feeding the sheet 100 to a print start position. The power supply key 72 is a switch that switches the power supply of the label printer 1 on and off.

The drive circuit 207 is connected to the thermal head 31 (more specifically, to the heater elements) that performs the printing on the sheet 100. The drive circuit 207 controls, based on a control signal from the CPU 201, a heat emitting mode of the entire thermal head 31 by controlling whether electricity is conducted to each of the heater elements of the thermal head 31. The feed motor 210 is connected to the drive circuit 208. The feed motor 210 is a motor for rotating the platen roller 26 (refer to FIG. 2). The drive circuit 208 controls driving of the feed motor 210 based on a control signal from the CPU 201. A stepping motor or a servomotor can be used as the feed motor 210. The drive circuit 208 controls a rotation direction (the positive rotation or the reverse rotation) and an amount of rotation of the feed motor 210. The light emitting portion of the optical sensor 95 is connected to the drive circuit 209. The drive circuit 209 causes light to be irradiated from the light emitting portion of the optical sensor 95 in accordance with a control signal from the CPU 201. The light receiving portion of the optical sensor 95 is connected to the input-output interface 206, and the detection result that depends on the strength of the reflected light received by the light receiving portion is output to the CPU 201.

The LAN connector (not shown in the drawings) is connected to the LAN interface 211. The USB connector (not shown in the drawings) is connected to the USB interface 212. The LAN interface 211 and the USB interface 212 perform transmission and reception of data with the external device that is connected via each of the connectors. The CPU 201 controls the printing in accordance with the print data received from the external device via the LAN interface 211 and the USB interface 212.

Figure 4:
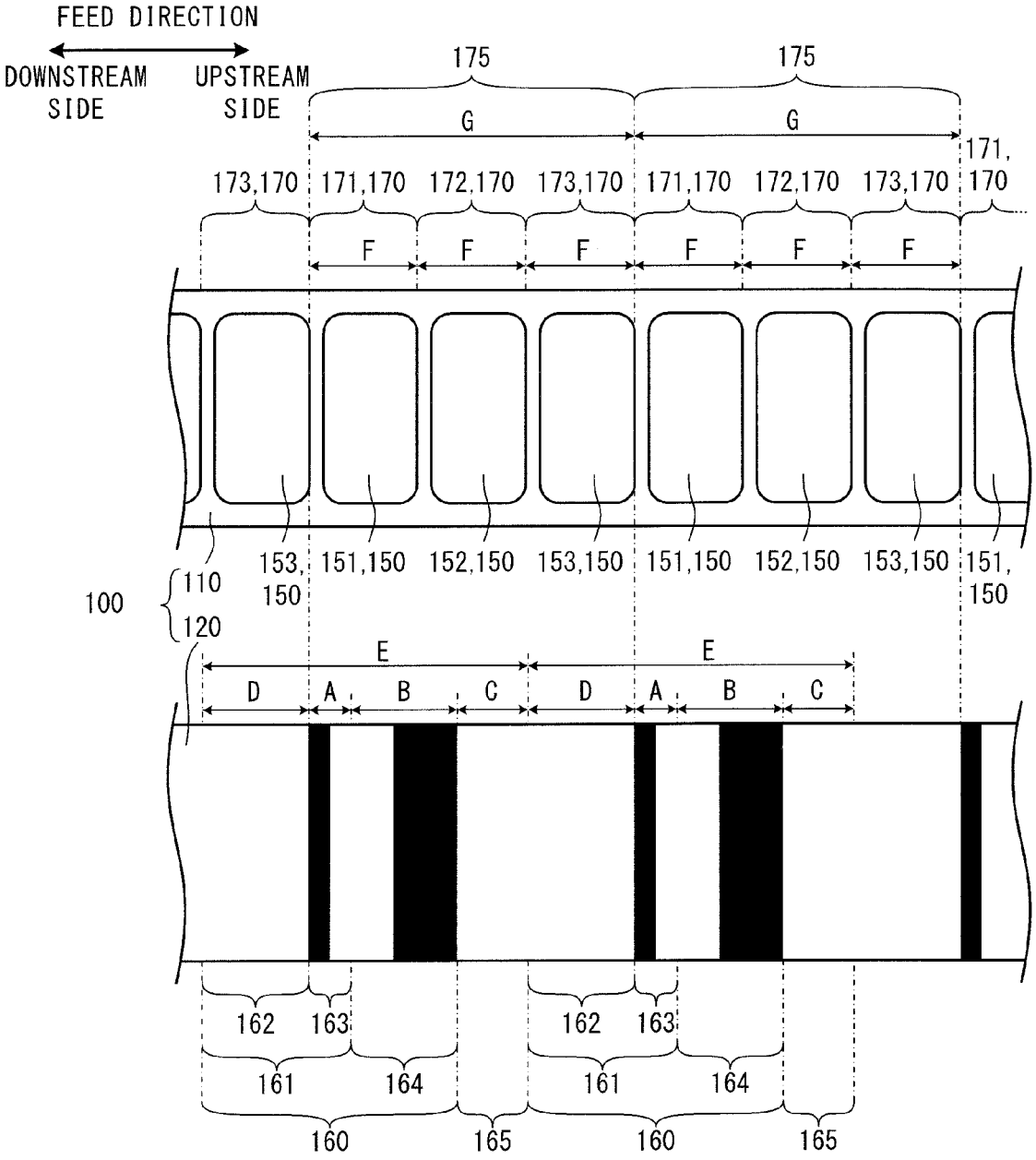
FIG. 4 is a diagram showing positional relationships between print areas on a top surface of the sheet and identification markers on a rear surface of the sheet.
Figure 5:
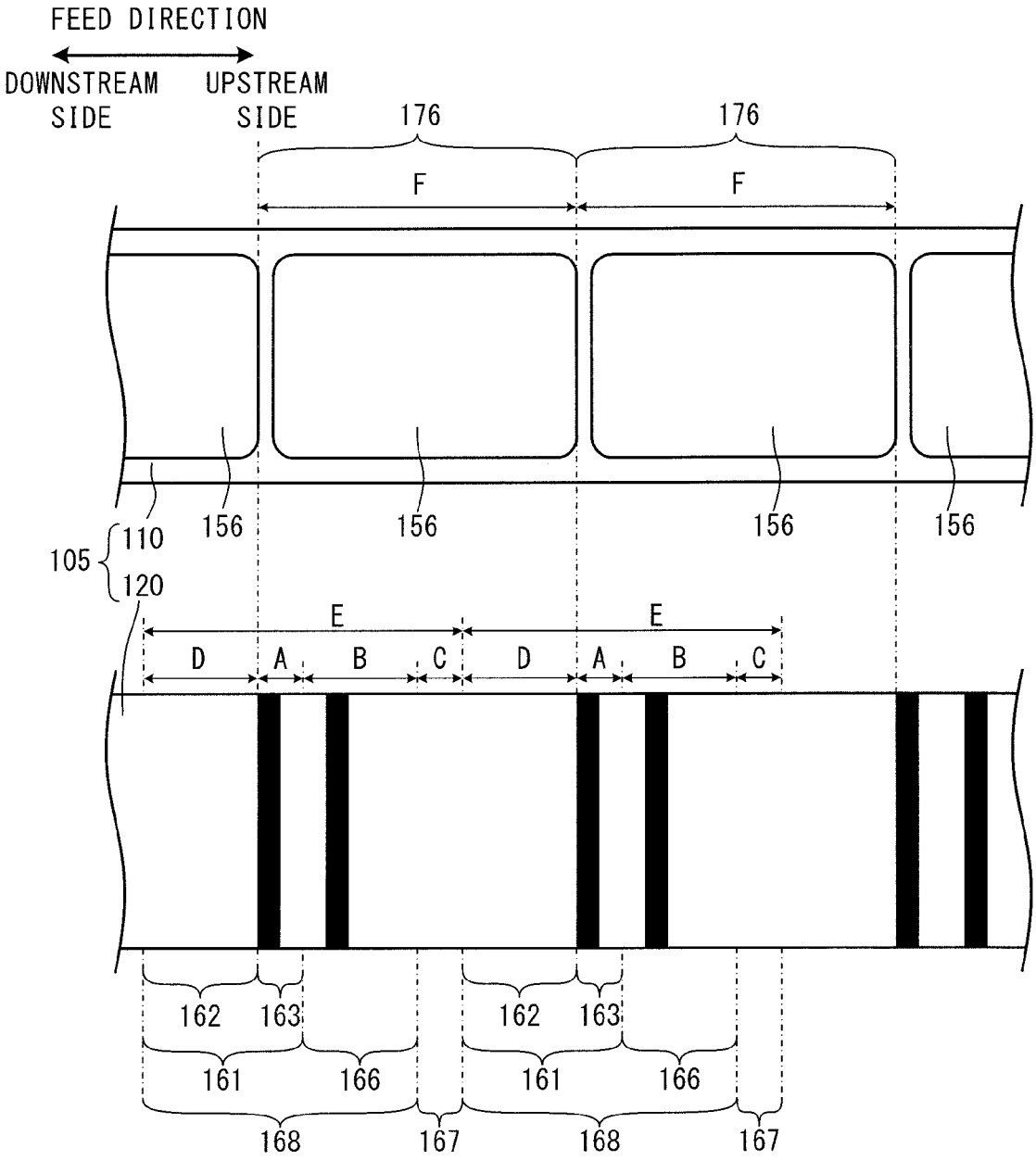
FIG. 5 is a diagram showing positional relationships between print areas on a top surface of the sheet and identification markers on a rear surface of the sheet.

The identification markers 160 and identification markers 168 of the sheet 100 and a sheet 105 will be explained with reference to FIG. 4 and FIG. 5. Note that the left-right direction in FIG. 4 and FIG. 5 corresponds to the feed direction of the sheets 100 and 105 in the label printer 1. The right direction in FIG. 4 and FIG. 5 is the upstream side in the feed direction, and the left side is the downstream side in the feed direction. Further, for contrast, the sheets 100 and 105 are shown arranged alongside each other in the up-down direction, in a state in which positions of the top surface 110 and the rear surface 120 are aligned in the feed direction. The sheet 100 exemplifies a case in which a plurality of print areas 170 correspond to one of the identification markers 160. The sheet 105 exemplifies a case in which a single print area 176 corresponds to one of the identification markers 168.

On the sheet 100 shown in FIG. 4, the top surface 110 is a printing surface of a heat-sensitive sheet on which printing is performed, and the rear surface 120 is the top surface of a release paper that is adhered to the heat-sensitive sheet. The plurality of labels 150 having a predetermined size are arranged at equal intervals in the feed direction on the top surface 110 of the sheet 100. A margin is provided between both edges of the sheet 100 in the width direction and each of the labels 150. The print area 170 corresponding to each of the labels 150 is set on the top surface 110 of the sheet 100. Each one of the print areas 170 is an area including one of the labels 150 and a margin portion that is positioned on the downstream side of the corresponding label 150. As will be explained in more detail later, on the sheet 100 of the present embodiment, three adjacent print areas 170 form a single print area group 175 and correspond to one of the identification markers 160. Hereinafter, for the purpose of explanation, the three adjacent print areas 170 that form the print area group 175 will be referred to, in order from the print area 170 on the downstream side in the feed direction, as a first print area 171, a second print area 172 and a third print area 173. In a similar manner, the labels 150 included in the first print area 171, the second print area 172 and the third print area 173 will be referred to, respectively, as a first label 151, a second label 152 and a third label 153.

The identification markers 160 are printed side by side at equal intervals in the feed direction on the rear surface 120 of the sheet 100, each of the identification markers 160 being a combination of a plurality of identifiers. In the present embodiment, each of the plurality of identifiers is represented by a band-shaped black line segment of a predetermined thickness (5 mm, for example) that extends in the width direction of the sheet 100. The identification marker 160 includes two pieces of information, namely, leading edge information 161 and identification information 164. The identification information 164 is arranged on the upstream side of the leading edge information 161. The leading edge information 161 is information for setting a leading edge position in the feed direction of the print area 170. The leading edge information 161 includes a blank area 162 and a leading edge identifier 163. The leading edge identifier 163 is arranged on the upstream side of the blank area 162. The blank area 162 is an area in which an identifier is not arranged, and is an uncolored area in which a base color of the release paper appears. A length D of the blank area 162 in the feed direction is set to be equal to or greater than a length B of the identification information 164. In the present embodiment, the length D of the blank area 162 is set to be 25 mm, for example. When the identification information 164 is formed only of a plurality of uncolored band-shaped line segments, the identification information 164 may be mistakenly recognized as the blank area 162. In a case where the length D of the blank area 162 is the same as the length B of the identification information 164, when a case in which all the identifiers are the uncolored band-shaped line segments, as the combination of the identifiers, is made invalid, it is possible for the identification information 164 to be distinguished. In a case where the length D of the blank area 162 is set to be longer than the length B of the identification information 164, the possibility that the identification information 164 is mistakenly recognized as the blank area 162 is further reduced.

The leading edge identifier 163 is represented by a combination of an identifier that is represented by a band-shaped black line segment and a single uncolored (plain) band-shaped line segment that is arranged on the upstream side of the identifier. A length A of the leading edge identifier 163 in the feed direction is set to be 10 mm, for example. The thickness of the single band-shaped black line segment included in the leading edge identifier 163 is set to be 5 mm, for example. In processing of the print control program that will be described later, after an area that is equal to or longer than the length D of the blank area 162 and in which an identifier is not arranged has been detected, when the single band-shaped black line segment that is the identifier is detected, the leading edge position of the print area 170 associated with the leading edge identifier 163 is detected.

The identification information 164 is information identifying a type of the sheet 100 depending on a combination of the identifier and the band-shaped uncolored (plain) band-shaped line segment arranged in an area of the length B. The area of the length B is an area in which a plurality of identifiers can be arranged. In the present embodiment, five of the identifiers can be arranged in the area of the length B. The label printer 1 can perform printing (printing that accords with labels on each of the types of sheet) in accordance with each of the plurality of types of sheet that have different sheet widths and for which a label size (the size in the feed direction and in the width direction) differs. The type of sheet and the combination of the identifiers (a recognition ID) in the identification information 164 are set in advance and a table is stored in the ROM 202. For example, in the case of the sheet 100 shown in FIG. 4, in the identification information 164, the identifiers are arranged in the following manner, in order from the downstream side: an uncolored (plain) line segment, an uncolored (plain) line segment, an identifier (black band), an identifier (black band) and an identifier (black band). Accordingly, the identification information 164 is acquired as the recognition ID represented by the binary number "00111". The recognition ID "00111" is, for example, associated with information indicating that the size (width×length) of the label 150 on the sheet 100 is 30×20 mm. Specifically, the identification information 164 of the present embodiment, in which the five identifiers can be arranged, can be associated with a maximum of 32 types of sheets in accordance with the combinations of the identifiers. However, the identification information 164 is arranged on the upstream side of the leading edge information 161. Thus, two types of combination are omitted that can be mistakenly recognized as the blank area 162 by being combined with a plain part of the leading edge information 161, and a maximum of 30 types of sheets are associated with the identification information 164.

The leading edge identifier 163 of the identification marker 160 is associated with the leading edge position of the first print area 171 of the print area group 175. Specifically, the identification marker 160 is provided, in the feed direction of the sheet 100, for each of the print area groups 175. An adjustment area 165, which is an area in which an identifier is not arranged, is provided between the adjacent identification markers 160. An arrangement interval E, which is an interval at which the leading edge positions of the identification markers 160 are arranged, corresponds to a length obtained by adding a length C of the adjustment area 165 to the length of the identification marker 160 (A+B+D). By adjusting the length C of the adjustment area 165, the arrangement interval E is adjusted such that the arrangement interval E corresponds to a length G of the print area group 175. Expressed differently, the length G of the print area group 175 is an arrangement interval between the leading edge positions of each of the first print areas 171, which is positioned on the furthermost downstream side among the three print areas 170 included in the print area group 175. The leading edge position of the first print area 171 is the position that is furthermost downstream of the first print area 171. In a case where a length of a single one of the print areas 170 is referred to as a length F, the length G of the print area group 175 that is formed of the three print areas 170 corresponds to a length 3F.

When the arrangement interval E between the identification markers 160 and an interval of the length G of the print area group 175 are the same interval, it is possible to accurately set the leading edge position of the print area group 175 as a print start position. In other words, when the arrangement interval between the leading edge positions of the first print areas 171 that are each positioned on the furthermost downstream side of the print area group 175 is the same interval, it is possible to accurately set the leading edge position of the print area group 175 as the print start position. Further, when the leading edge position of each of the print areas 170 included in the print area group 175 is also identified by taking the leading edge position of the identification marker 160 as a reference, it is also possible to accurately set the leading edge position of the print area 170 as the print start position. In addition, the print areas 170 having the same size are arranged side by side in the feed direction. Thus, when a number of the print areas 170 forming the print area group 175 is freely set, with respect to the identification markers 160 that are associated in a one-to-one correspondence with each of the print area groups 175, the single identification marker 160 is provided corresponding to the number of integral multiples of the print areas 170. As long as the size of each of the print areas 170 is the same, when the print start position is set taking the leading edge position of the single print area 170 as a reference, it is possible to set the print start position for the other print areas 170 as the leading edge position of each of the print areas 170 by simply adding the length F of the print area 170 in the feed direction. Furthermore, as the sheet 100 has the adjustment area 165, the length G of the print area group 175 can be easily adjusted such that the length G is the same as the arrangement interval E between the identification markers 160.

In this manner, when the length F of the single print area 170 is shorter than the length (A+B+D) of the identification marker 160, the print area groups 175 each including the plurality of print areas 170 are set on the sheet 100. On the sheet 100, in a state in which the identification marker 160 is aligned with the print area group 175, each of the identification markers 160 are repeatedly provided in a one-to-one correspondence with each of the print area groups 175.

On the other hand, as shown in FIG. 5, in a case where the length F of the single print area 176 is equal to or longer than the length (A+B+D) of the identification marker 160, the print area groups 175 are not set. The single identification marker 168 is set with respect to the single print area 176. One label 156 is included in the print area 176. The size (width×length) of the label 156 is, for example, 30×50 mm. In the case of the sheet 105 shown in FIG. 5, the leading edge information 161 that is formed of the blank area 162 and the leading edge identifier 163 is the same as that of the sheet 100 (refer to FIG. 4). However, identification information 166 is information representing the label 156. More specifically, in the identification information 166, the identifiers are arranged in the following manner, in order from the downstream side: an uncolored (plain) line segment, an identifier (black band), an uncolored (plain) line segment, an uncolored (plain) line segment, and an uncolored (plain) line segment. In other words, the identification information 166 is acquired as the recognition ID represented by the binary number "01000". An adjustment area 167 is set such that the length F of the print area 176 is the same as the arrangement interval E between the leading edge positions of the identification markers 168. The length (A+B+D) of the identification marker 168 is constant, irrespective of the type of the sheet 105. Using the adjustment area 167, the leading edge position of the print area 176 and the leading edge position of the identification marker 168 are adjusted so that they are aligned with each other. The label printer 1 of the present embodiment can use the sheet 105 for which the length F of the print area 176 is greater than the length (A+B+D) of the identification marker 168, and can also use the sheet 100 for which the length F of the print area 170 is shorter than the length (A+B+D) of the identification marker 160. In order for the label printer 1 to be able to use a greater number of types of sheets, it is sufficient to increase the number of identifiers that can be included in the identification information 164. However, in this case, the length (A+B+D) of the identification marker 160 is increased. Therefore, as in the present embodiment, when the sheet 100, for which the length F of the print area 170 is shorter than the length (A+B+D) of the identification marker 160, can be used, the label printer 1 can handle a variety of the labels 150.

Figure 7:
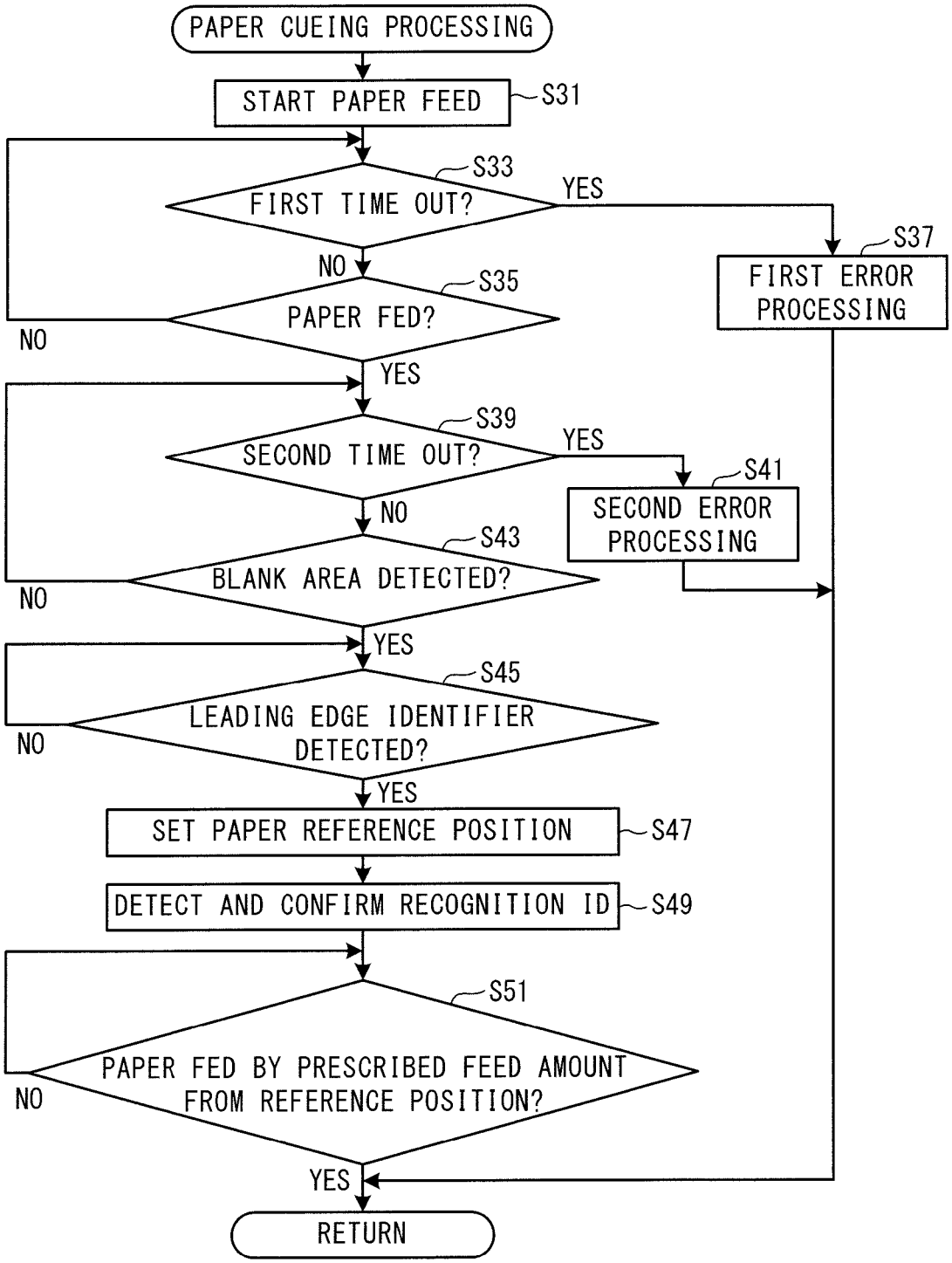
FIG. 7 is a flowchart of paper cueing processing.
Figure 8:
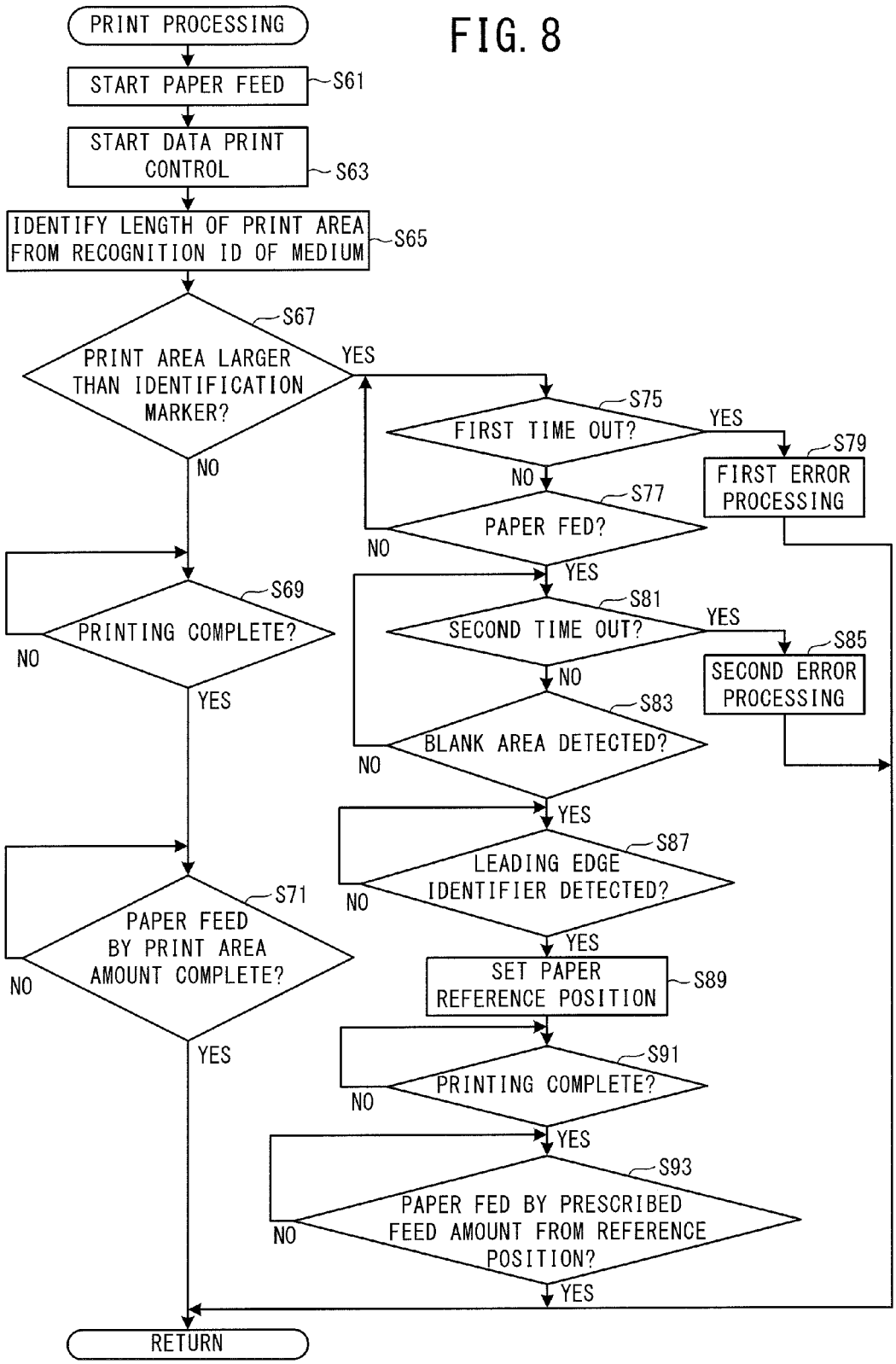
FIG. 8 is a flowchart of print processing.

The print control program that is executed by the label printer 1 of the present embodiment will be explained with reference to FIG. 6 to FIG. 8. The CPU 201 executes the print control program and performs printing on the labels 150 of the sheet 100 based on the print data received from the external device. The print control program is started when the print data is received that is transmitted from one of the external devices connected via either the LAN interface 211 or the USB interface 212, and is executed by the CPU 201 in accordance with the program stored in the ROM 202.

Figure 6:
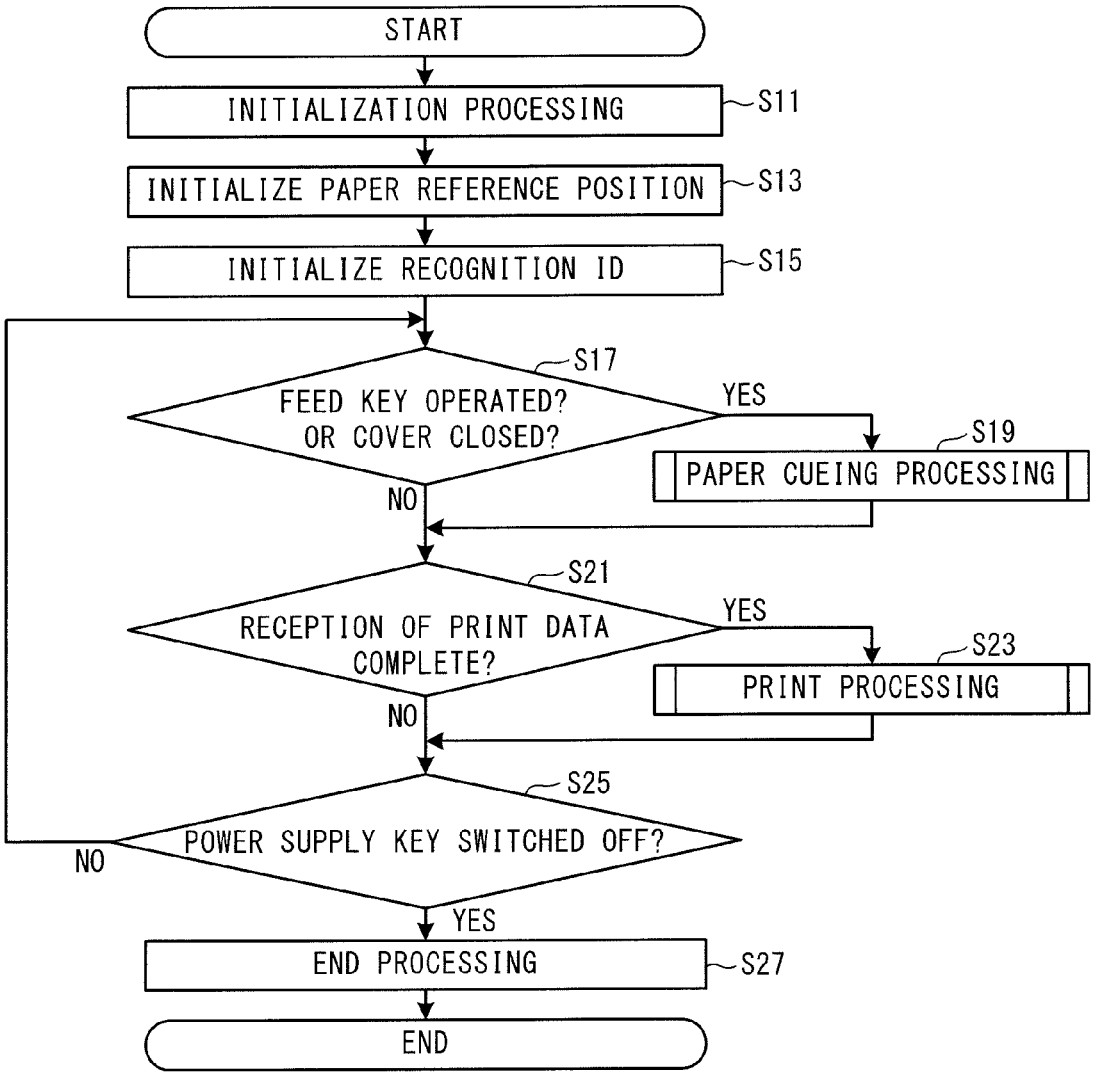
FIG. 6 is a flowchart of a main routine of a print control program that is executed by the label printer.

As shown in FIG. 6, when the user activates the label printer 1 by operating the power supply key 72 and a main routine of the print control program is started, the CPU 201 performs initialization processing when the program is executed (step S11). The CPU 201 secures the storage areas of the RAM 203, reads various types of flag and default values of variables that are used in the program from the ROM 202 or from the flash ROM 204, stores the read values in the RAM 203 and performs initialization. Further, the CPU 201 verifies operation of the feed motor 210, the thermal head 31 and the optical sensor 95 etc. The CPU 201 performs processing to initialize a reference position of the paper (the sheet) (step S13). The reference position is the leading edge position of the print area 170 that is detected on the furthermost downstream side in the feed direction based on the identification marker 160, when the sheet 100 is fed when the label printer 1 is used one time. The label printer 1 feeds the sheet 100 based on the reference position, aligns each of the labels 150 with respect to the thermal head 31, and performs printing on the labels 150 of the sheet 100. A state in which the label printer 1 is activated is a state in which the reference position detected when the label printer 1 was driven the previous time is set in the flash ROM 204. In processing at step S13, the CPU 201 initializes the reference position and sets a state in which the reference position is not yet set. The CPU 201 initializes the recognition ID of the medium (the sheet) (step S15). The state in which the label printer 1 is activated is a state in which the recognition ID of the sheet 100 used when the label printer 1 was used the previous time is stored in the flash ROM 204. By processing at step S15, the CPU 201 initializes the recognition ID and sets a state in which the recognition ID is not yet recognized.

The CPU 201 determines whether the FEED key 71 of the operation portion 7 has been operated, or whether the cover 5 has been closed (step S17). In a case where the FEED key 71 has not been operated and the cover 5 has not been closed (no at step S17), the CPU 201 advances the processing to step S21. In a case where the sheet 100 has already been set in the label printer 1 and the user has operated the FEED key 71 and the sheet 100 has been cued (yes at step S17), the CPU 201 advances the processing to step S19. Also, in a case where the user sets the new or replacement sheet 100 in the label printer 1 and closes the cover 5 (yes at step S17), the CPU 201 advances the processing to step S19. At step S19, a sub routine of paper cueing processing (refer to FIG. 7) is called up. In the paper cueing processing, which will be described in more detail later, after the sheet 100 has been set in the reference position, the leading edge position of the print area 170 is set in a position corresponding to the position to start printing by the thermal head 31. When the paper cueing processing is complete, the CPU 201 advances the processing to step S21.

In a case where the print data has been transmitted from the external device, the CPU 201 determines whether reception of the print data is complete (step S21). When the print data is not transmitted or when the print data is still being received, the CPU 201 advances the processing to step S25. When the print data is transmitted from the external device and the reception of the transmitted print data is complete (yes at step S21), the CPU 201 advances the processing to step S23. At step S23, a sub routine of print processing (refer to FIG. 8) is called up. The print processing will be described later. When the print processing is complete, the CPU 201 advances the processing to step S25.

When the user has operated the power supply key 72 and ended operation of the label printer 1 (yes at step S25), the CPU 201 performs processing to end the print control program (step S27). The CPU 201 opens the storage areas of the RAM 203 and ends the program. In a case where the power supply key 72 has not been operated (no at step S25), the CPU 201 returns the processing to step S17. The CPU 201 repeatedly performs the processing from step S17 to step S25 until the power supply key 72 is operated.

The paper cueing processing, which is the sub routine at step S19, will be explained. As shown in FIG. 7, when the paper cueing processing is performed, the CPU 201 transmits an instruction to the drive circuit 208 of the feed motor 210 and causes the platen roller 26 etc. to rotate, thus starting feeding of the paper (the sheet 100) (step S31). The CPU 201 transmits an instruction to the drive circuit 209 and drives the optical sensor 95, then reads a detection value from the optical sensor 95 and detects the paper. Even if the paper is not detected, the CPU 201 stands by until a predetermined time period (5 seconds, for example) that is set in advance has elapsed (no at step S33; no at step S35). There are cases in which the sheet 100 is not disposed on the feed path 22, such as a case in which the holder 3 that holds the sheet 100 is not properly set in the storage portion 4, or a case in which a paper jam occurs or the like. In a case where the sheet 100 is not disposed on the feed path 22 even when the predetermined time period has elapsed (yes at step S33), the CPU 201 determines that a first time out has occurred, and performs first error processing (step S37). The first error processing is processing performed by the CPU 201 when the first time out has occurred. In the first error processing, the CPU 201 stops the driving of the feed motor 210 and the optical sensor 95, and transmits an error code indicating that there is no paper to the external device that is the transmission source of the print data. The CPU 201 ends the paper cueing processing and returns to the main routine (refer to FIG. 6).

In a case where the sheet 100 is disposed in the feed path 22 within the predetermined time period (no at step S33; yes at step S35), the CPU 201 advances the processing to step S39. The CPU 201 performs detection of the blank area 162 based on the detection value of the optical sensor 95. A feed speed of the sheet 100 by the platen roller 26 is constant. Therefore, a time required for the sheet 100 to travel the length D of the blank area 162 in the feed direction is determined in advance. The CPU 201 determines whether the blank area 162 has been detected (step S43). Specifically, based on the detection value of the optical sensor 95, the CPU 201 determines whether the blank area 162 has been detected, based on whether a value obtained when the base color of the release paper is detected is detected continuously for the time (or longer) that is required to feed the sheet 100 by the length D of the blank area 162.

Even if the blank area 162 is not detected, the CPU 201 stands by until a predetermined time period (2 seconds, for example) that is set in advance has elapsed (no at step S39; no at step S43). In a case where the predetermined time period has elapsed without the blank area 162 being detected (no at step S39), the CPU 201 determines that a second time out has occurred and performs second error processing (step S41). The second error processing is processing performed by the CPU 201 when the second time out has occurred. In the second error processing, the CPU 201 stops the driving of the feed motor 210 and the optical sensor 95, and transmits an error code indicating that there is no identification marker to the external device that is the transmission source of the print data. The CPU 201 ends the paper cueing processing and returns to the main routine (refer to FIG. 6).

When the blank area 162 is detected within the predetermined time period (no at step S39; yes at step S43), the CPU 201 advances the processing to step S45. The CPU 201 performs detection of the leading edge identifier 163 based on the detection value of the optical sensor 95. When the leading edge identifier 163 is not detected (no at step S45), the CPU 201 stands by until the leading edge identifier 163 is detected. When the leading edge identifier 163 is detected (yes at step S45), the CPU 201 determines a current feed position of the sheet 100 as the print reference position, and sets the determined reference position in the flash ROM 204 (step S47). The CPU 201 further feeds the sheet 100 and, based on the detection value of the optical sensor 95, detects the recognition ID (step S49). The CPU 201 reads the identification information 164 (the recognition ID) that is arranged on the upstream side of the leading edge identifier 163 on the rear surface 120 of the sheet 100. The CPU 201 acquires information relating to the size of the label 150 by referring to the table stored in the ROM 202, and stores the acquired size-related information in the flash ROM 204. By the leading edge identifier 163 being detected by the optical sensor 95 and determining the reference position, it is possible to reliably identify the leading edge position even when each of the print areas 170 does not have a direct correspondence to the leading edge identifier 163.

Corresponding relationships between the position that the CPU 201 detects the leading edge identifier 163 using the optical sensor 95 as the reference position and each of the print areas 170 are identified in advance for each of the types of the label 150 and the identified corresponding relationships are stored in a table. For example, in a case where the sheet 100 is set in the reference position, when the sheet 100 is fed from the set position by X mm in the downstream direction, for example, the leading edge position of the first print area 171 is set in a position corresponding to the print start position for printing by the thermal head 31. X mm is a distance that depends on a positional relationship between the print start position of the thermal head 31 on the feed path 22 and the position of the optical sensor 95. When the sheet 100 is fed by the length F of the print area 170 to the downstream side from positions that correspond to the leading edge position of the first print area 171 and the leading edge position of the second print area 172, the leading edges of each of the second print area 172 and of the third print area 173 are set in positions corresponding to the print start position for printing by the thermal head 31. Based on the information stored in the table, the CPU 201 identifies the feed amount of the sheet 100 to the print start position of each of the print areas 170, based on the reference position, and feeds the sheet 100 such that the sheet 100 is positioned properly with respect to the thermal head 31.

In a case where the length F of each of the print areas 170 in the feed direction is shorter than the length (A+B+D) of the identification marker 160, when the identification information 164 is read by the optical sensor 95, a part of the print area 170 (the first print area 171, for example) may be fed further downstream than the print start position for printing by the thermal head 31. In the present embodiment, after the reference position is identified, when the sheet 100 is fed, the current position of the sheet 100 is identified taking the reference position as a point of origin, and when the leading edge position of each of the print areas 170 is aligned with the print start position, the feed amount is identified based on a difference between the reference position and the current position of the sheet 100. In a case where the feed amount is a positive value, the CPU 201 causes the feed motor 210 to rotate in the positive direction, and feeds the sheet 100 from the upstream side to the downstream side. When the feed amount is a negative value, the CPU 201 causes the feed motor 210 to rotate in the reverse direction and feeds the sheet 100 from the downstream side to the upstream side.

At step S51, when the printing is performed for the first time on the label 150, the CPU 201 feeds the sheet 100 by the identified prescribed feed amount from the reference position (no at step S51). When the feeding of the sheet 100 by the prescribed amount is complete and the leading edge position of the first print area 171 is set to the print start position (yes at step S51), the CPU 201 ends the paper cueing processing and returns the processing to the main routine (refer to FIG. 6).

The print processing, which is a sub-routine at step S23 shown in FIG. 6, will be explained. As shown in FIG. 8, when the print processing is performed, the CPU 201 transmits an instruction to the drive circuit 208 of the feed motor 210, and causes the platen roller 26 etc. to rotate, thus starting feeding of the paper (the sheet 100) (step S61). The CPU 201 expands the print data, which has been completely received from the external device, into the print buffer and generates dot pattern data. The CPU 201 starts printing based on the print data expanded into the print buffer (step S63). The optical sensor 95 before the start of printing is in a state of detecting the leading edge identifier 163. The CPU 201 reads the identification information 164 at the same time as the start of printing, and acquires the identification information 164 (the recognition ID) of the sheet 100 (step S65). The CPU 201 identifies the length F of each of the print areas 170 of the sheet 100 on which the printing is to be performed.

In a case where the sheet 105 for which the length (A+B+D) of the identification marker 168 is equal to or less than the length F of the print area 176 (no at step S67), after the printing has been performed on the label 156 of the print area 176, the sheet 105 is fed by the length F while taking a pre-printing state as a reference, and thus the leading edge position of the next print area 176 is set to the print start position and the leading edge identifier 163 of the identification marker 168 is also arranged in the position corresponding to the print area 176. Therefore, in a case where the sheet 105 for which the length (A+B+D) of the identification marker 168 is equal to or less than the length F of the print area 176 (no at step S67), the CPU 201 does not perform detection of the identification marker 168 each time of printing, and performs the printing based on the print data expanded into the print buffer (no at step S69). When the printing is complete (yes at step S69), the CPU 201 feeds the sheet 100 from the print start position by the amount of the length F of the print area 176 (no at step S71). When the feeding of the sheet 100 is complete (yes at step S71), the CPU 201 ends the print processing and returns the processing to the main routine (refer to FIG. 6).

In a case where the length (A+B+D) of the identification marker 160 is greater than the length F of the print area 170 (yes at step S67), similarly to the paper cueing processing (refer to FIG. 7), the setting of the reference position, which to be the reference for the paper cueing at the next time of printing, is performed. The CPU 201 performs detection of the sheet 100 based on the detection value from the optical sensor 95 (no at step S75; no at step S77). In a case where the first time out has occurred (yes at step S75), the CPU 201 performs the first error processing (step S79). The CPU 201 ends the print processing and returns the processing to the main routine (refer to FIG. 6). In a case where the sheet 100 is detected without the first time out occurring (no at step S75; yes at step S77), the CPU 201 advances the processing to step S81.

The CPU 201 performs detection of the blank area 162 based on the detection value of the optical sensor 95 (no at step S81; no at step S83). In a case where the second time out has occurred (yes at step S81), the CPU 201 performs the second error processing (step S85). The CPU 201 ends the print processing and returns the processing to the main routine (refer to FIG. 6). In a case where the blank area 162 is detected without the second time out occurring (no at step S81; yes at step S83), the CPU 201 advances the processing to step S87. The CPU 201 performs detection of the leading edge identifier 163 based on the detection value of the optical sensor 95 (no at step S87). When the CPU 201 has detected the leading edge identifier 163 (yes at step S87), the current feed position of the sheet 100 is determined as the reference position for printing and the determined reference position is set in the flash ROM 204 (step S89).

When printing on the sheet 100 is to be continued (no at step S91), the CPU 201 stands by until printing is complete. When the printing is complete (yes at step S91), the CPU 201 feeds the sheet 100 by the prescribed feed amount from the reference position (no at step S93). For example, when the printing on the first label 151 is complete, in order to perform printing on the second label 152, the sheet 100 is fed by the prescribed feed amount from a state in which the first print area 171 that includes the first label 151 is set with the reference position as a reference. The prescribed feed amount is the length F of the print area 170. When the feeding of the sheet 100 by the prescribed feed amount is complete and the leading edge position of the print area 170 is set to the print start position for printing by the thermal head 31 (yes at step S93), the CPU 201 ends the print processing and returns the processing to the main routine (refer to FIG. 6). By feeding the sheet 100 by the prescribed feed amount after the printing is complete, the CPU 201 can set the leading edge position of the print area 170 on which printing is to be performed next to the print start position.

The present disclosure is not limited to the above-described embodiment, and various modifications may be made within the scope and spirit of the present disclosure. The line segments that form the identification marker 160 are provided in the width direction of the sheet 100 such that the line segments cross the entire width, but the line segments may be arranged on the edge portions in the width direction. The identification marker 160 is provided on the rear surface 120 of the sheet 100, but may be provided on the top surface 110 (in a margin portion, for example) along with the label 150. The identifier included in the identification marker 160 is the black band-shaped line segment, and black and white gradation is detected by the optical sensor 95. However, the color of the identifier may be any color as long as it is a color that can be distinguished from the base color of the sheet 100 by the optical sensor 95. Further, for example, the identification marker 160 may be formed by an invisible coating, such as a UV coating or the like, and the identification marker may be detected using a sensor that can distinguish the coating that is used. The label printer 1 performs printing by thermal development of color using the heat-sensitive sheet as the sheet 100, but the sheet 100 is not limited to the heat-sensitive sheet, and a general purpose printing paper or copy paper may be used and printing may be performed by a known method, such as an inkjet method, a laser method, a transfer ribbon method or a dot impact method etc. The sheet 100 is supplied as the roll sheet that is wound on the spool 35, but a long sheet that is folded over, with folds formed by perforations at each of a predetermined length, may be used as the sheet 100.

Each of the labels 150 of the sheet 100 is the same size, and the print areas 170 are provided at an equal interval in the feed direction. However, the present disclosure is not limited to this example, and a plurality of labels of differing sizes may be arranged in the feed direction. In this case, when print area groups are formed by print areas that include the plurality of labels of differing sizes, it is preferable that the combination of the plurality of print areas that form each of the print area groups is the same for each of the plurality of print area groups.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A print medium comprising:

a plurality of print areas that are set along a longitudinal direction on a printing surface, the longitudinal direction being a direction in which the print medium in sheet form extends and being a direction along a feed direction in which the print medium is to be fed when printing is performed, and the plurality of print areas being a plurality of areas on which printing is to be performed; and a plurality of identification markers that are intermittently printed along the longitudinal direction on the print medium, each of the plurality of identification markers including a set of leading edge information and identification information and being printed in correspondence with a single print area group, the leading edge information being information for setting a leading edge position of the print area in the feed direction, the identification information being information for identifying a type of the print medium, more than one of the plurality of the print areas being located between two of the plurality of the identification markers adjacent with each other, and the print area group being formed of a plurality of mutually adjacent print areas among the plurality of print areas, wherein the plurality of print areas are print areas having a same length in the feed direction as each other, an arrangement interval between leading edge positions of the plurality of identification markers is an interval, in the feed direction, that is an integral multiple of an arrangement interval between the leading edge positions of the plurality of print areas, the leading edge information includes:

a leading edge identifier, which is an identifier that extends in a band shape along a width direction that is orthogonal to the feed direction, and a blank area, which is an area that is connected to the leading edge identifier on a downstream side in the feed direction and that has a predetermined length, and in which the identifier is not arranged, and a length of the blank area in the feed direction is equal to or longer than a length of the identification information in the feed direction.

2. The print medium according to claim 1, wherein an arrangement interval between leading edge positions of the plurality of identification markers in the feed direction is an interval that corresponds to an arrangement interval between each of leading edge positions of the print area that is positioned on the furthermost downstream side in the feed direction among the plurality of print areas that are included in the print area group.

3. The print medium according to claim 1, wherein a length of each of the plurality of print areas in the feed direction is shorter than a length of each of the plurality of identification markers in the feed direction.

4. The print medium according to claim 1, further comprising:

an adjustment area, which is an area provided between the identification markers that are adjacent and in which an identifier is not arranged, wherein a length of the adjustment area in the feed direction is set depending on a length of the print area in the feed direction.

* * * * *